US008429843B2

(12) United States Patent
Yan

(10) Patent No.: US 8,429,843 B2
(45) Date of Patent: Apr. 30, 2013

(54) FOREGRIP

(75) Inventor: Yuedong Yan, Northville, MI (US)

(73) Assignee: Leapers, Inc., Livonia, MI (US)

( * ) Notice: Subject to any disclaimer, the term of this patent is extended or adjusted under 35 U.S.C. 154(b) by 151 days.

(21) Appl. No.: 13/096,676

(22) Filed: Apr. 28, 2011

(65) Prior Publication Data

US 2012/0272557 A1 Nov. 1, 2012

(51) Int. Cl.
*F41C 23/16* (2006.01)
*B25G 1/04* (2006.01)
*F41C 27/00* (2006.01)

(52) U.S. Cl.
USPC ..... 42/72; 42/71.01

(58) Field of Classification Search ..... 42/71.01, 42/72, 73; 16/429; 89/1.42
See application file for complete search history.

(56) References Cited

U.S. PATENT DOCUMENTS 1,695,071 A * 12/1928 Villapando ..... 42/71.01
2,547,180 A * 4/1951 Taylor ..... 42/16
2,933,843 A * 4/1960 McFeeter ..... 42/85
4,502,238 A * 3/1985 Farrar et al. ..... 42/72
5,068,992 A * 12/1991 Velezis et al. ..... 42/72
5,417,002 A * 5/1995 Guerra ..... 42/72
7,793,454 B1 * 9/2010 Beltz ..... 42/94
7,861,451 B1 1/2011 Moody et al.
7,987,623 B1 * 8/2011 Moody et al. ..... 42/72
2005/0115140 A1 * 6/2005 Little ..... 42/118
2006/0242880 A1 * 11/2006 Griffin ..... 42/73
2007/0056202 A1 * 3/2007 Oz ..... 42/94
2009/0193702 A1 8/2009 Lin
2009/0211140 A1 8/2009 Rolfe
2009/0313873 A1 12/2009 Roth
2011/0167699 A1 * 7/2011 Griffin ..... 42/72

* cited by examiner

*Primary Examiner* — Bret Hayes
(74) *Attorney, Agent, or Firm* — Honigman Miller Schwartz and Cohn LLP

(57) ABSTRACT

A grip is disclosed. The grip comprises a base portion; a grip portion pivotably connected to the base portion for arrangement in one of: a deployed orientation, a stowed orientation and an intermediate orientation, wherein the grip portion includes a first, inner body, and a second, outer body, wherein the second, outer body is movably- and telescopingly-connected to the first, inner body; and a locking assembly arranged within and at least partially contained by the grip portion, wherein a portion of the locking assembly is selectively-extendable in one of an orientation within the grip portion and beyond an outer surface of the grip portion for selective coupling of the portion of the locking assembly with the base portion. A method for operating a grip is also disclosed. An assembly is also disclosed.

27 Claims, 8 Drawing Sheets

FOREGRIP

TECHNICAL FIELD

The disclosure relates to a foregrip.

BACKGROUND

Foregrips are known in the art. Improvements to foregrips are continuously being sought in order to advance the art.

DESCRIPTION OF THE DRAWINGS

The disclosure will now be described, by way of example, with reference to the accompanying drawings, in which.

DETAILED DESCRIPTION

The figures illustrate an exemplary implementation of a foregrip. Based on the foregoing, it is to be generally understood that the nomenclature used herein is simply for convenience and the terms used to describe the invention should be given the broadest meaning by one of ordinary skill in the art.

Figure 1A:
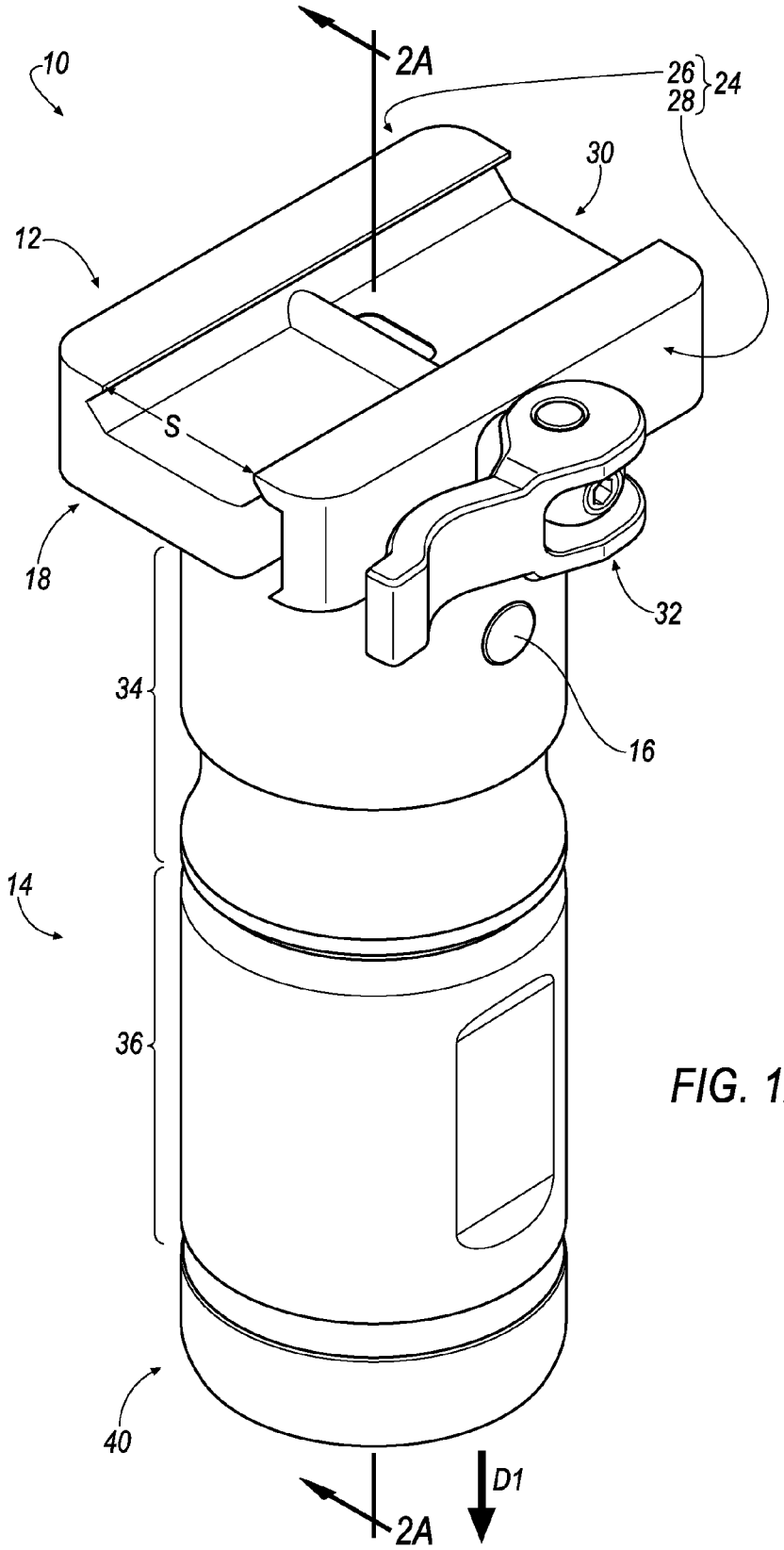
FIG. 1A is a perspective view of an exemplary foregrip.

FIGS. 1A-1B and 3A-3B illustrate an exemplary foregrip shown generally at 10. In FIGS. 1A/3A, the foregrip 10 is shown configured in first orientation whereas, in FIGS. 1B/3B, the foregrip 10 is shown configured in a second orientation that is different from that of the first orientation.

In an embodiment, the foregrip 10 may include a base portion 12 and a grip portion 14. The grip portion 14 is pivotably-coupled to the base portion 12 by way of, for example, a pivot pin 16, fastener, bolt or the like.

Figure 1B:
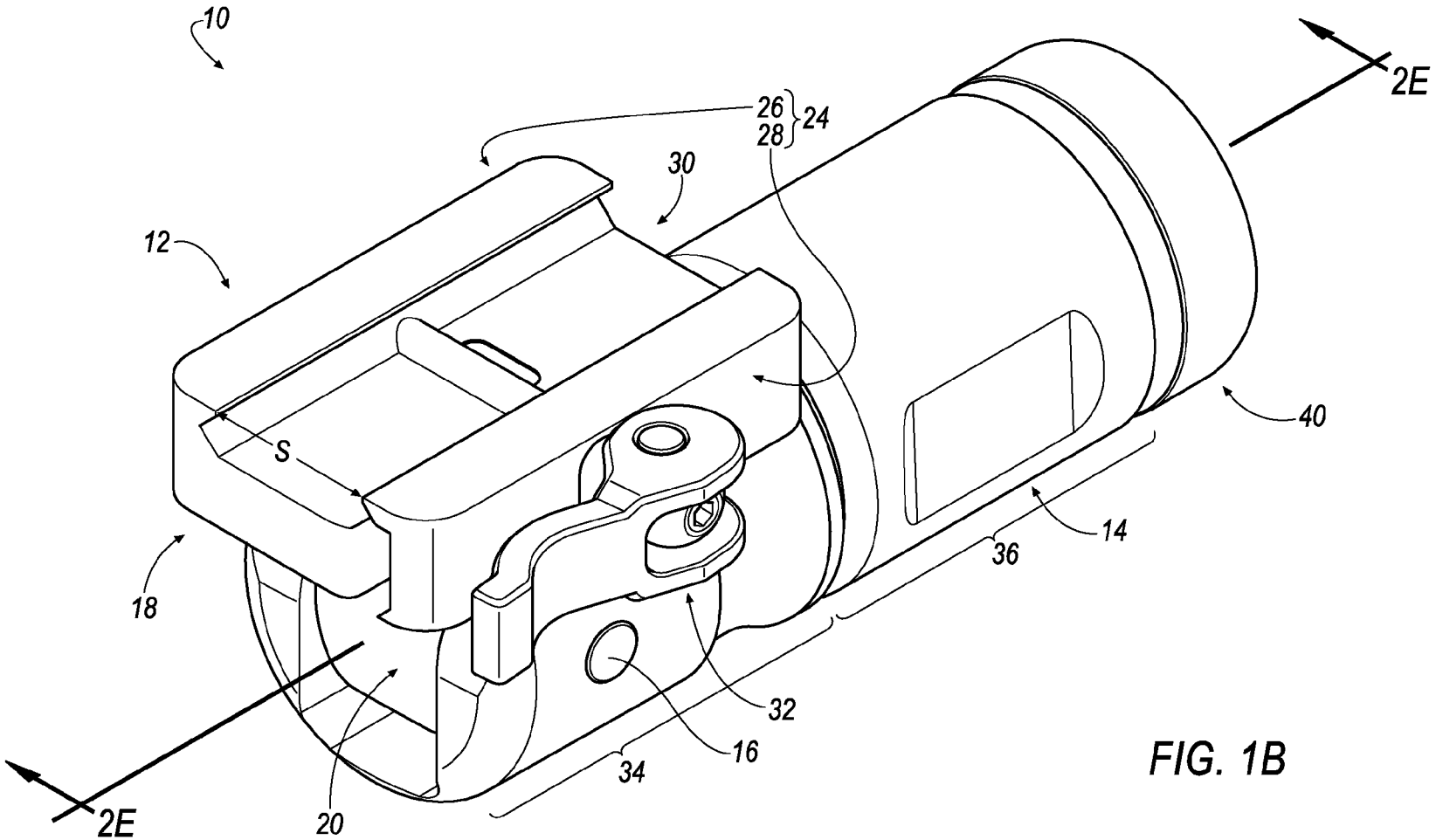
FIG. 1B is a perspective view of the foregrip of FIG. 1A in an adjusted orientation.

In an implementation, the "first orientation" of the foregrip 10 of FIGS. 1A/3A may be referred to as an "extended/deployed" orientation whereas, the "second orientation" of the foregrip 10 in FIGS. 1B/3B may be referred to as a "collapsed/stowed" orientation. The use of the terms extended/deployed and collapsed/stowed may, in an implementation, arise from a frame of reference/attachment of the foregrip 10 to, for example, another device, such as, for example, a firearm, F (see, e.g., FIGS. 3A-3B).

Figure 3A:
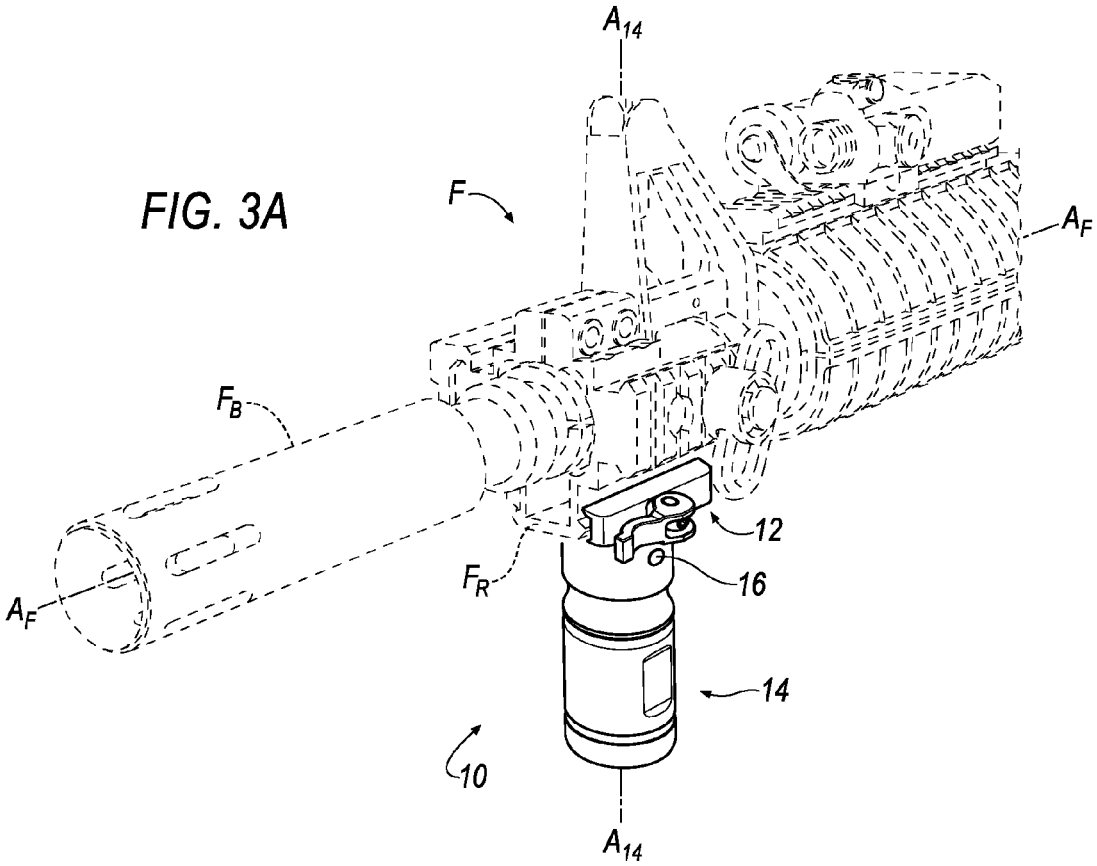
FIG. 3A is a view of the foregrip of FIG. 1A attached to a firearm.
Figure 3B:
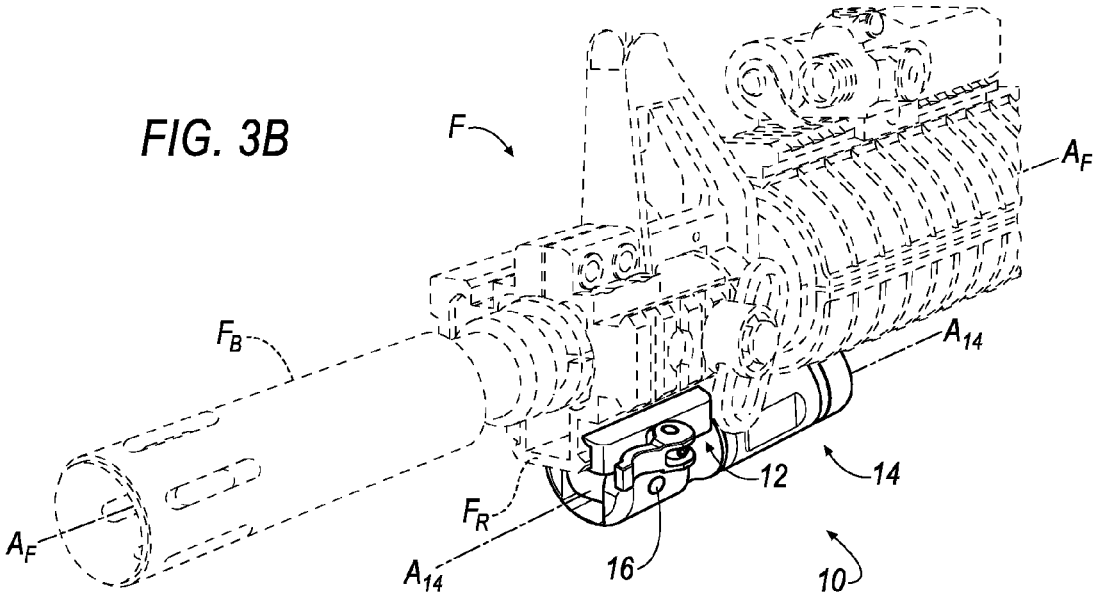
FIG. 3B is a view of the foregrip of FIG. 1B attached to a firearm.

Further, in some implementations, the foregrip 10 may be referred to as a "grip." In the illustrated implementation of FIGS. 3A-3B, the grip 10 is shown mounted to the firearm, F, in a forward orientation with respect to a handle-grip (not shown) of the firearm, F, that may be proximate a trigger (not shown); accordingly, because of the forward orientation of the grip 10 with respect to the handle-grip/trigger, the grip 10 may be referred to as a "foregrip." Irrespective of a particular location of the device described in the present disclosure, the device may be referred to a "grip," "foregrip" or the like, as desired.

As seen in FIG. 3A, when the foregrip 10 is arranged in the extended/deployed orientation relative to the firearm, F, a grip portion axis, $A_{14}$-$A_{14}$, may be axially aligned with the grip portion 14, and, may, for example, substantially perpendicularly traverse a firearm axis, $A_F$-$A_F$, extending along, for example, a barrel portion, $F_B$, of the firearm, F. As seen in FIG. 3B, when the foregrip 10 is arranged in the collapsed/stowed orientation relative to the firearm, F, the grip portion axis, $A_{14}$-$A_{14}$, may, for example, not be arranged substantially perpendicularly with respect to or traverse the firearm axis, $A_F$-$A_F$, extending along, for example, the barrel portion, $F_B$, of the firearm, F, but, rather, be arranged, for example, substantially in parallel with the firearm axis, $A_F$-$A_F$.

Although shown attached to a firearm, F, the foregrip 10 is not limited to be attached to a device, F, that launches relatively small projectiles such as, for example, bullets, paint balls, or the like. In an alternative embodiment, the foregrip 10 may be attached to, for example, a cross-bow that launches, for example, arrows. Further, the foregrip 10 is not limited to being attached to projectile-launching devices, and, may alternatively be attached to any device, such as, for example, a power tool.

Referring to FIGS. 1A-1B, the base portion 12 may generally include a head portion 18 and a neck portion 20 (see FIGS. 1B and 2A-2E). The neck portion 20 includes a passage 22 (see FIGS. 2A-2E) that permits insertion of the pivot pin 16 for pivotably-connecting the base portion 12 to the grip portion 14.

The head portion 18 may at least partially form a quick-disconnect device 24. Functionally, the quick-disconnect device 24 permits a quick and simple detachment/attachment of the foregrip 10 to the firearm, F.

Referring to FIGS. 1A-1B, the quick-disconnect device 24 may include a first clamp portion 26 and a second clamp portion 28 that collectively form a channel 30 including a geometry that corresponds to, for example, a Picatinny rail, $F_R$ (FIGS. 3A-3B), of the firearm, F. The second clamp portion 28 is movably-arranged with respect to a fixed orientation of the first clamp portion 26 in order to enlarge/reduce the width geometry of the channel 30 for permitting detachment/attachment of the foregrip 10 to the firearm.

Movement of the second clamp portion 28 with respect to the first clamp portion 26 is conducted by way of rotational movement of a lever 32. According to the illustrated orientation of the quick-disconnect device 24 of FIGS. 1A-1B, the lever 32 is shown in an "open position" such that the second clamp portion 28 has been adjusted to at least a partial "open orientation" with respect to the fixed orientation of the first clamp portion 26; as a result, an enlarged spacing, S, between the first clamp portion 26 and the second clamp portion 28 is provided. The open orientation of the quick-disconnect device 24 may permit, for example, the foregrip 10 to be detached from the Picatinny rail, $F_R$, of the firearm, F.

Referring to FIGS. 1A-1B, the grip portion 14 may generally include a first, inner body 34 and a second, outer body 36 that telescopingly-receives the first, inner body 34. In order to permit the foregrip 10 to be adjusted from the extended/deployed orientation of FIG. 1A to the collapsed/stowed orientation of FIG. 1B, the second, outer body 36 is initially moved (e.g., pulled) according to the direction of the arrow, D1 (see, e.g., FIGS. 1A and 2A).

Referring to FIGS. 2A-2E, a locking assembly is shown generally at 100 according to an embodiment. The locking assembly 100 may functionally permit the grip portion 14 to be locked (see, e.g., FIGS. 2A, 2E) relative to the base portion 12 in one of the extended/deployed orientation of FIGS. 1A, 2A and the collapsed/stowed orientation of FIG. 1B, 2E.

Figure 2A:
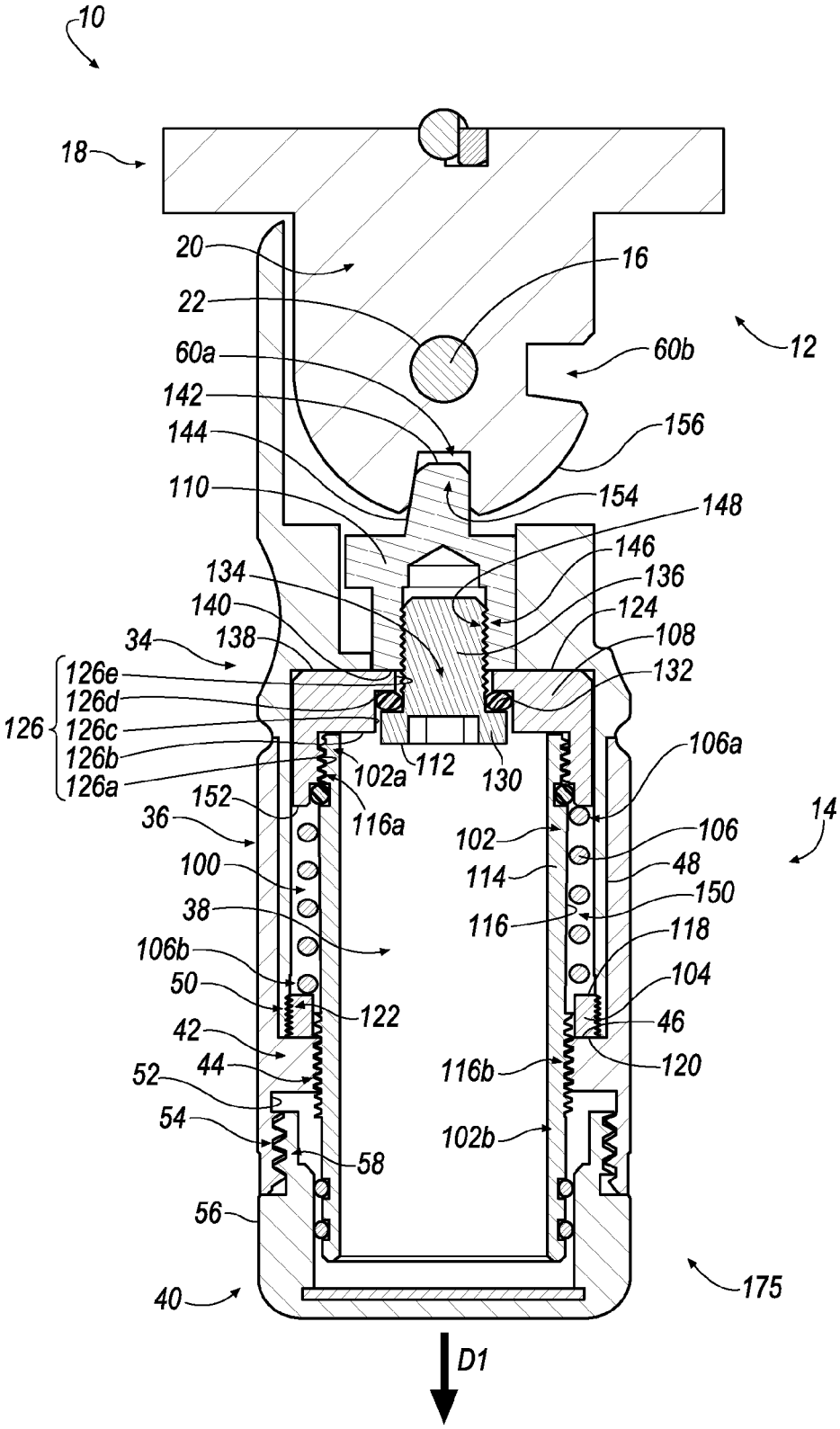
FIG. 2A is a cross-sectional view of the foregrip of FIG. 1A according to line 2A-2A.

Referring to FIG. 2A, the locking assembly 100 is disposed within and is at least partially contained by the grip portion 14. In an embodiment, the locking assembly 100 may be disposed within a bore 38 formed by one or more of the first, inner body 34 and the second, outer body 36. An end cap 40 may be connected to, for example, an end of the second, outer body 36 opposite that of the base portion 12 for closing-out the bore 38.

In an implementation, the locking assembly 100 includes a carrier body 102, a stop ring 104, a tension spring 106, a stop cap 108, a locking wedge 110 and a locking wedge fastener 112. The carrier body 102 includes a substantially tubular body 114 having a first threaded outer surface portion 116*a* and a second threaded outer surface portion 116*b*. In an embodiment, the first, outer threaded surface portion 116*a* may be located proximate a first, upper end 102*a* of the carrier body 102 and the second, outer threaded surface portion 116*b* may be located proximate a second, lower end 102*b* of the carrier body 102.

The second, outer body 36 of the grip portion 14 may include a radially-inwardly projecting annular ledge 42. The annular ledge 42 may include an inner threaded surface 44 that permits the second, outer body 36 to be threadingly-coupled to the second, outer threaded surface portion 116*b* of the carrier body 102.

The stop ring 104 includes an upper surface 118, a lower surface 120 and an outer threaded surface portion 122. The annular ledge 42 includes an upper surface 46 that may be disposed adjacent and support the lower surface 120 of the stop ring 104.

The first, inner body 34 of the grip portion 14 may include an outer surface portion 48 and an inner threaded surface 50. The outer threaded surface portion 122 of the stop ring 104 may be threadingly-coupled to the inner threaded surface 50 of the first inner body 34.

The stop cap 108 includes an outwardly-facing surface portion 124 and a plurality of inwardly-facing, stepped surface portions 126 formed by stepped surfaces 126*a*-126*e*. The stepped surfaces 126*a*-126*e* include: a first threaded surface portion 126*a*, a first ledge surface portion 126*b*, a first non-threaded surface portion 126*c*, a second ledge surface portion 126*d* and a second non-threaded surface portion 126*e*.

The first threaded surface portion 126*a* is substantially perpendicularly connected to the first ledge surface 126*b*. The first ledge surface portion 126*b* is substantially perpendicularly connected to the first non-threaded surface portion 126*c*. The first non-threaded surface portion 126*c* is substantially perpendicularly connected to the second ledge surface portion 126*d*. The second ledge surface portion 126*d* is substantially perpendicularly connected to the second non-threaded surface portion 126*e*.

The first threaded surface portion 126*a* may be threadingly-coupled to the first, outer threaded surface portion 116*a* of the carrier body 102. The first ledge surface 126*b* may be disposed adjacent the first, upper end 102*a* of the carrier body 102. The first non-threaded surface portion 126*c* may form an annular cavity that accommodates a head portion 130 of the locking wedge fastener 112. The second ledge surface portion 126*d* may be disposed adjacent or opposite a surface portion 132 of the head portion 130 of the locking wedge fastener 112. The second non-threaded surface portion 126*e* forms a passage 134 extending through the stop cap 108. The passage 134 permits a stem portion 136 of the locking wedge fastener 112 to extend through the passage 134 and beyond an upper surface portion 138 of the stop cap 108.

The locking wedge 110 includes a lower surface 140, an upper surface 142 and an outer surface 144 connecting the lower surface 140 to the upper surface 142. The lower surface 140 of the locking wedge 110 may be disposed substantially adjacent the upper surface portion 138 of the stop cap 108.

The lower surface 140 of the locking wedge 110 may further define a threaded bore 146 extending into the locking wedge 110. The threaded bore 146 may be coupled to a threaded outer surface 148 of the stem portion 136 of the locking wedge fastener 112 that extends through the passage 134 and beyond the upper surface portion 138 of the stop cap 108.

Each of the first inner body 34, the carrier body 102, the stop ring 104 and the stop cap 108 may be designed in a manner such that, upon threadingly-coupling the first inner body 34, the carrier body 102, the stop ring 104 and the stop cap 108 as described above, an annular bore 150 is formed that accommodates reception of the tension spring 106. Accordingly, when arranged within the annular bore 150, (1) a first end 106*a* of the tension spring 106 may be disposed adjacent a lower surface portion 152 of the stop cap 108, (2) a second end 106*b* of the tension spring 106 may be disposed adjacent the upper surface 118 of the stop ring 104, and (3) the tension spring 106 circumscribes the outer surface portion 116 of the carrier body 102.

Once the locking assembly 100 is disposed within the bore 38 formed by one or more of the first, inner body 34 and the second, outer body 36, the end cap 40 is connected to the second, outer body 36 for closing-out the bore 38. The connection of the end cap 40 to the second, outer body 36 may be accomplished by way of a threaded connected. For example, an inner surface 52 of the second, outer body 36 may include a threaded surface portion 54, and, an outer surface 56 of the end cap 40 may include a threaded surface portion 58 that is threadingly-coupled to the threaded surface portion 54 of the second, outer body 36.

As will be described at FIGS. 2A-2D, a threadingly-connected assembly 175 is defined by the connection of: (1) the end cap 40 to the second, outer body 36, (2) the second, outer body 36 to carrier body 102, (3) the carrier body 102 to the stop cap 108, and (4) the stop ring 104 to the first, inner body 34. Accordingly, as a result of the threadingly-connected assembly 175, a user may grasp and pull, D1, on one or more of the end cap 40 and the second, outer body 36 in order to manipulate the locking assembly to/from an un/locked orientation in order to permit the foregrip 10 to be arranged in one of the extended/deployed orientation of FIG. 1A and the collapsed/stowed orientation of FIG. 1B.

Referring initially to FIG. 2A, the tension spring 106 is shown in an expanded, at rest orientation within the annular bore 150 along with the locking wedge 110, which may form a male portion 154, being nested within a first recess 60*a* formed in the neck portion 20 of the base portion 12. As a result of the male portion 154 being nested within the first recess 60*a*, the foregrip 10 may be said to be locked in the extended/deployed orientation.

Figure 2B:
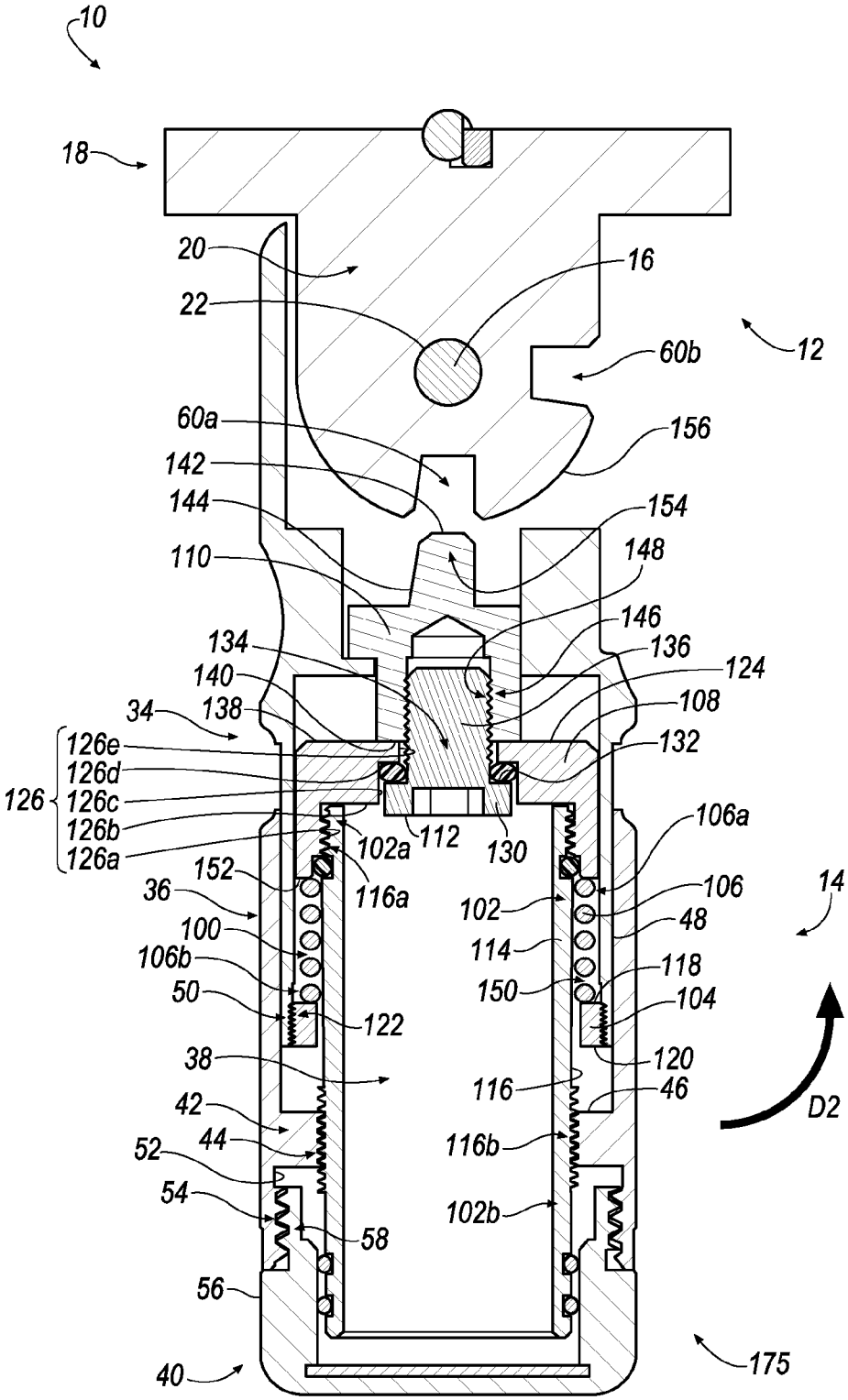
FIG. 2B is a cross-sectional view of the foregrip according to FIG. 2A in a partially adjusted orientation.

As seen in FIG. 2B, upon applying a pulling force, D1 (see, e.g., FIG. 2A), to one or more of the end cap 40 and the second, outer body 36, the pulling force, D1, causes movement of the following components of the threadingly-connected assembly 175: (1) firstly, the threaded connection of the second, outer body 36 to the carrier body 102 causes the carrier body 102 to be moved according to the direction of the arrow, D1, (2) secondly, the threaded connection of the carrier body 102 to the stop cap 108 causes the stop cap 108 to also be moved according to the direction of the arrow, D1, (3) thirdly, because the locking wedge 110 is connected to the stop cap 108 by way of the locking wedge fastener 112, upon moving the stop cap 108 according to the direction of the arrow, D1, the locking wedge 110 is correspondingly-moved according to the direction of the arrow, D1, such that the male portion 154 is no longer nested within the first recess 60*a*. Upon retracting the male portion 154 from the first recess 60*a*, the grip portion 14 may be said to be unlocked from the base portion 12.

As seen in FIGS. 2A-2E, although part of the threadingly-connected assembly 175, the stop ring 104 is not moved according to the direction of the arrow, D1; the stop ring 104 remains statically-connected in a fixed orientation to the first, inner body 34 by way of the threadingly-connected surfaces 50/122 and is not movable according to the direction of the arrow, D1. As a result of the lack of movement of the stop ring 104 according to the direction of the arrow, D1, the stop cap 108 pushed downwardly upon the tension spring 106 according to the direction of the arrow, D1, such that, as seen in FIG. 2B, the tension spring 106 is changed in orientation from the expanded, at rest orientation within the annular bore 150 to a compressed orientation within the annular bore 150 against the stop ring 104.

Figure 2C:
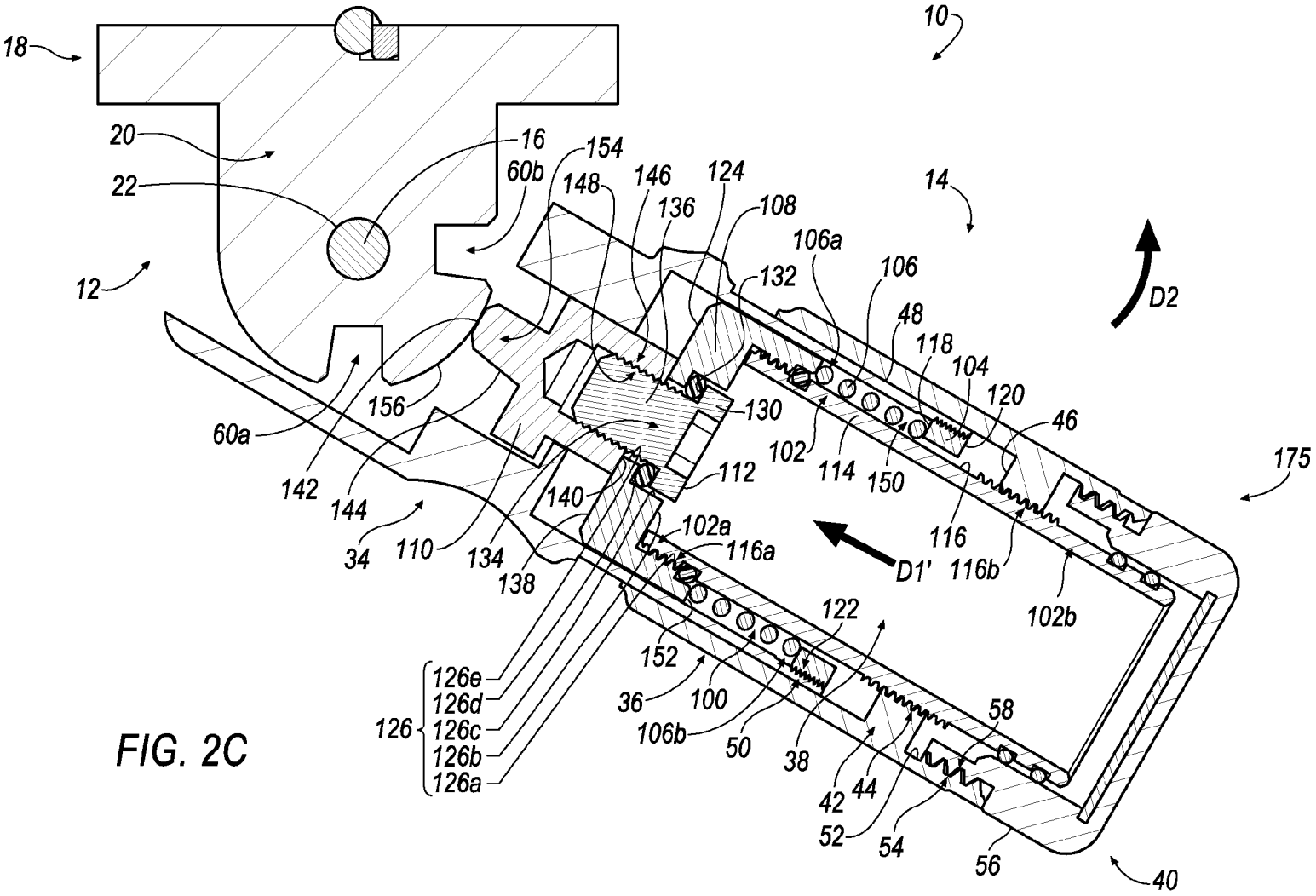
FIG. 2C is a cross-sectional view of the foregrip according to FIG. 2B in a partially adjusted orientation.
Figure 2D:
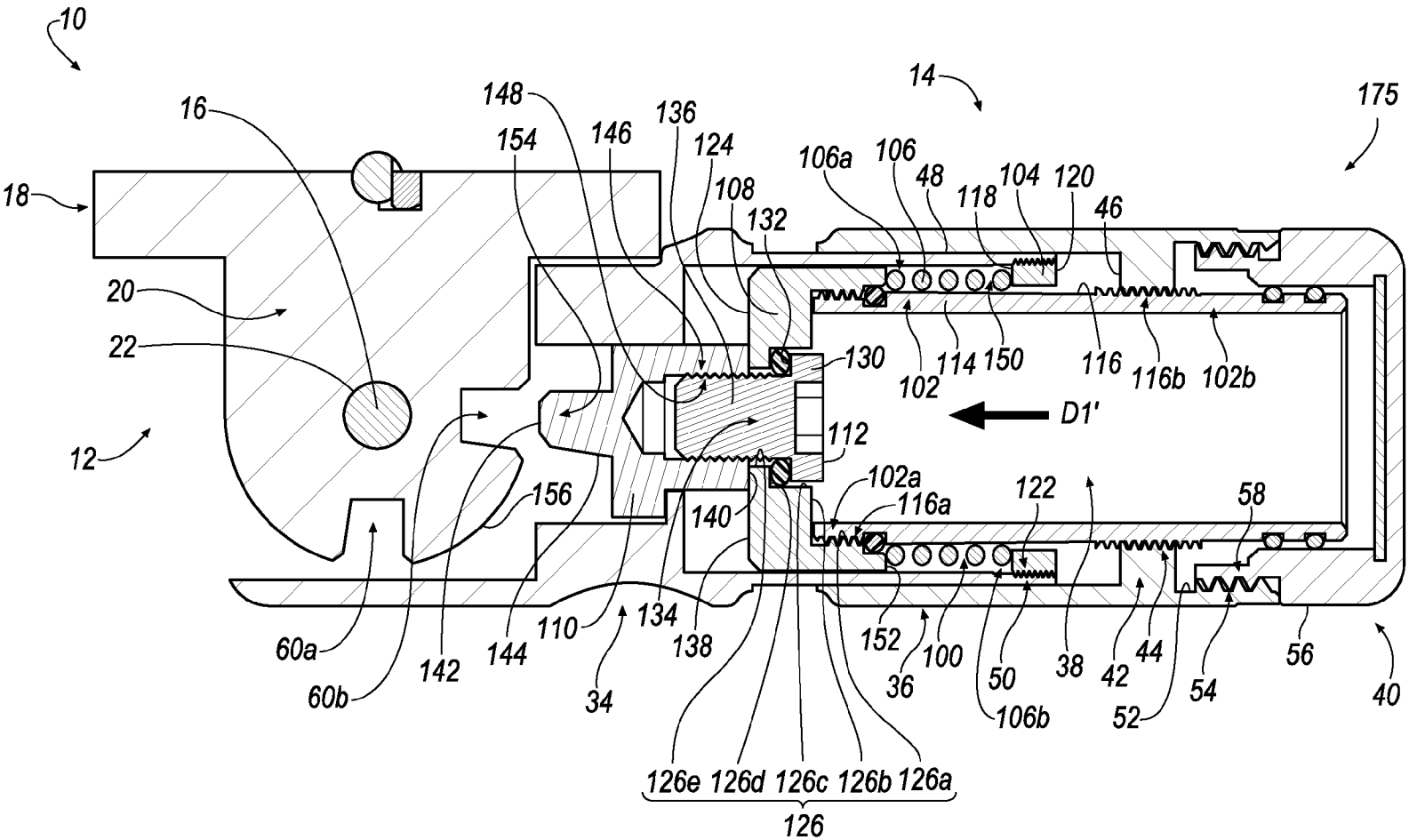
FIG. 2D is a cross-sectional view of the foregrip according to FIG. 2C in another partially adjusted orientation.

Referring to FIG. 2B, upon retracting the male portion 154 from the first recess 60*a* as described above, the grip portion 14 may be said to be unlocked from the base portion 12 such that the grip portion 14 may be permitted to pivot according to the direction of the arrow, D2, relative to the base portion 12. Referring to FIGS. 2C-2D, upon pivoting, D2, the grip portion 14, the user may electively release the pulling force according to the direction of the arrow, D1. Upon pivoting, D2, the grip portion 14, the upper surface 142/male portion 154 of the locking wedge 110 is no longer aligned with the first recess 60*a*, but, rather, is aligned with an arcuate surface portion 156 of the neck portion 20.

As described above, at any time during the pivoting, D2, of the grip portion 14, the pulling force, D1, may be electively released. Referring to FIG. 2C, upon electively releasing the pulling force, D1, energy that is stored by the compressed tension spring 106 is at least partially released according to the direction of the arrow, D1', which is opposite that of the arrow, D1. However, because the upper surface 142/male portion 154 of the locking wedge 110 is no longer aligned with the first recess 60*a*, but, rather, is aligned with an arcuate surface portion 156 of the neck portion 20, the energy stored by the compressed tension spring 106 is at least partially released such that the upper surface 142/male portion 154 is biased substantially adjacent to the arcuate surface portion 156 of the neck portion 20. Accordingly, because the upper surface 142/male portion 154 may be arranged substantially adjacent the arcuate surface portion 156 of the neck portion 20, the energy stored by the compressed tension spring 106 is prohibited from being completely released upon a user electively releasing the pulling force, D1. Thus, as a result, the tension spring 106 may remain in at least partially compressed orientation within the annular bore 150 against the stop ring 104 as the grip portion 14 is pivoted, D2, relative to the base portion 12.

Referring to FIGS. 2B-2D, when the upper surface 142/male portion 154 is arranged substantially adjacent/opposite the arcuate surface portion 156 or not nested within a recess 60*a*, 60*b* formed in the neck portion 20, the grip portion 14 may be said to be pivotally arranged in an "intermediate" orientation. The intermediate orientation may be an orientation of the grip portion 14 that is other than a locked orientation with the base portion 12, or, between the extended/deployed orientation and the collapsed/stowed orientation.

Referring to FIG. 2D, the grip portion 14 may be said to be approximately arranged in the collapsed/stowed orientation when the upper surface 142/male portion 154 of the locking wedge 110 is no longer aligned with the arcuate surface portion 156 of the neck portion 20, but, rather when the upper surface 142/male portion 154 of the locking wedge 110 is substantially aligned with a second recess 60*b* formed in the neck portion 20 of the base portion 12. In an implementation, the first recess 60*a* and the second recess 60*b* may be offset by one another by approximately 90°; accordingly, the pivoting motion, D2, may be limited to be about 90°.

As seen in FIG. 2D, the tension spring 106 is illustrated as being in the compressed orientation within the annular bore 150. The compressed orientation of the tension spring 106 may arise from the user still applying the pulling force, D1; alternatively, the illustrated, compressed orientation of the tension spring 106 may arise from the upper surface 142/male portion 154 of the locking wedge 110 being about but not completely substantially aligned with the second recess 60*b* formed in the neck portion 20.

Figure 2E:
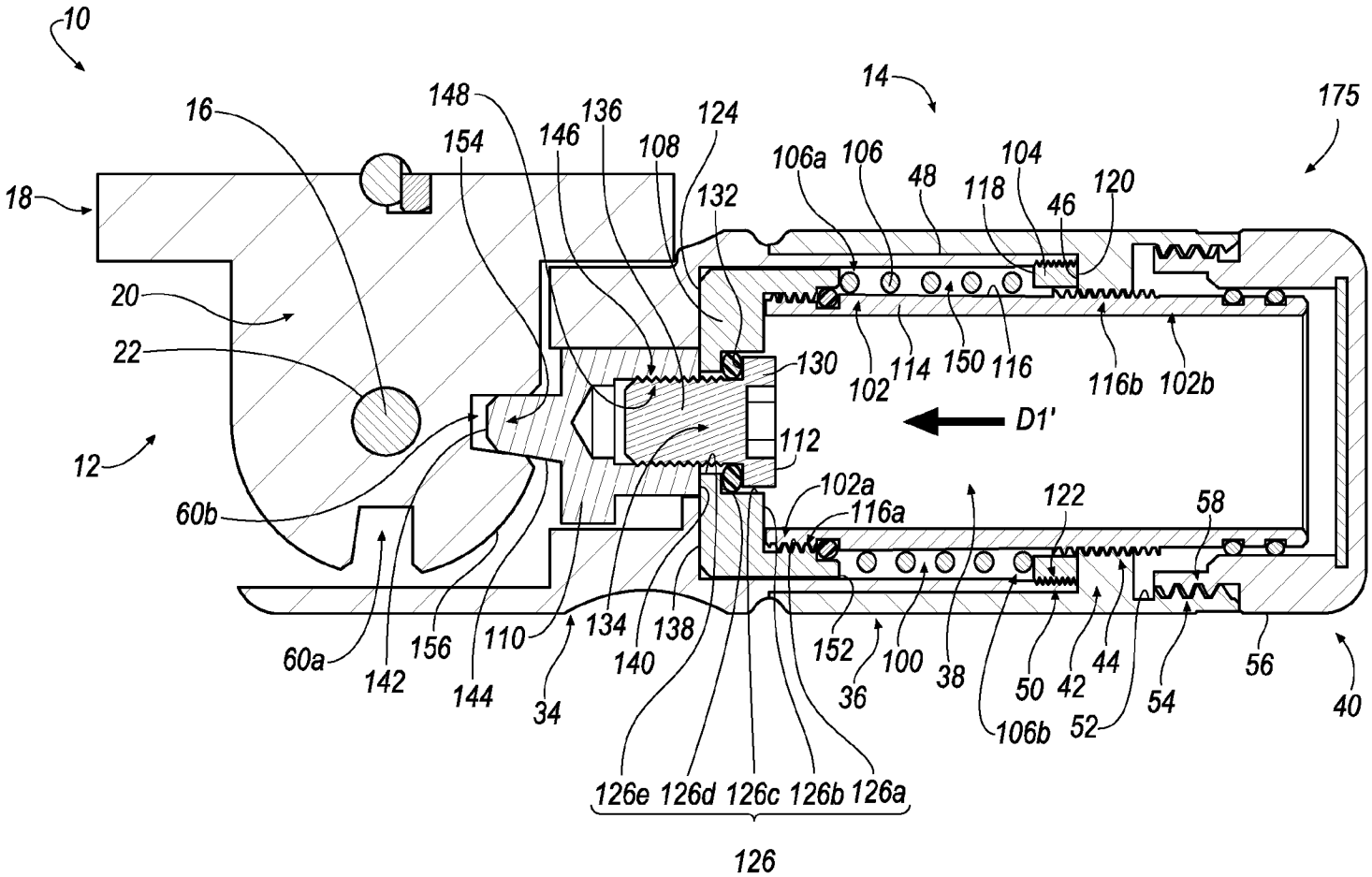
FIG. 2E is a cross-sectional view of the foregrip of FIG. 1B according to line 2E-2E

Referring to FIG. 2E, the upper surface 142/male portion 154 of the locking wedge 110 is no longer aligned with aligned with an arcuate surface portion 156 of the neck portion 20, but, rather, is aligned with the second recess 60*b*. As a result of the arcuate surface portion 156 no longer impeding expansion of the compressed tension spring 106 and/or the user no longer applying the pulling force, D1, the tension spring 106 is permitted to expand and release energy such that the upper surface 142/male portion 154 of the locking wedge 110 is driven into and registered within the second recess 60*b* such that the grip portion 14 may be said to be locked relative to the base portion 12.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A grip that is attachable to a device, comprising:

a base portion;

a grip portion pivotably connected to the base portion for arrangement in one of: a deployed orientation, a stowed orientation and an intermediate orientation, wherein the grip portion includes a first, inner body, and a second, outer body, wherein the second, outer body is movably- and telescopingly-connected to the first, inner body;

a locking assembly arranged within and at least partially contained by the grip portion, wherein a portion of the locking assembly is selectively-extendable in one of an orientation within the grip portion and beyond an outer surface of the grip portion for selective coupling of the portion of the locking assembly with the base portion, wherein the deployed orientation includes: a grip portion axis that is axially aligned with the grip portion while also substantially perpendicularly traversing a device axis of the device, wherein the stowed orientation includes the grip portion axis being arranged substantially in parallel with the device axis, wherein one or more of the first, inner body and the second, outer body of the grip portion form a bore, wherein the locking assembly is disposed within the bore; and an end cap removably-connected to an end of the second, outer body for at least partially closing-out the bore.

2. The grip according to claim 1, wherein the locking assembly provides:

means for locking the grip portion to the base portion in one of the deployed orientation and the stowed orientation when the portion of the locking assembly is selectively-extended beyond the outer surface of the grip portion and interfaced with the base portion.

3. The grip according to claim 1, wherein the device is a firearm, wherein the device axis is a firearm axis, wherein the firearm axis is aligned with a barrel portion of the firearm.

4. A grip that is attachable to a device, comprising:

a base portion;

a grip portion pivotably connected to the base portion for arrangement in one of: a deployed orientation, a stowed orientation and an intermediate orientation, wherein the grip portion includes a first, inner body, and a second, outer body, wherein the second, outer body is movably- and telescopingly-connected to the first, inner body; and a locking assembly arranged within and at least partially contained by the grip portion, wherein a portion of the locking assembly is selectively-extendable in one of an orientation within the grip portion and beyond an outer surface of the grip portion for selective coupling of the portion of the locking assembly with the base portion, wherein the deployed orientation includes: a grip portion axis that is axially aligned with the grip portion while also substantially perpendicularly traversing a device axis of the device, wherein the stowed orientation includes the grip portion axis being arranged substantially in parallel with the device axis, wherein the locking assembly includes:

a stop ring connected to the first, inner body, a carrier body connected to the second, outer body, a stop cap connected to the carrier body, a locking wedge fastener connected to the stop cap, a locking wedge connected to the locking wedge fastener, wherein, collectively: the first, inner body, the carrier body, the stop ring and the stop cap form an annular bore, wherein the locking assembly further includes a tension spring disposed within the annular bore.

5. The grip according to claim 4, wherein a first end of the tension spring is disposed adjacent the stop cap, wherein a second end of the tension spring is disposed adjacent the stop ring, wherein the tension spring circumscribes an outer surface of the carrier body.

6. The grip according to claim 5, wherein the stop ring is fixedly-coupled to the first, inner body, wherein the stop cap is not fixedly-coupled to the first, inner body such that movement of the carrier body and second, outer body results in corresponding movement of the stop cap to provide means for utilizing movement of the stop cap to permit compression of the tension spring against a fixed orientation the stop ring with the first, inner body.

7. The grip according to claim 6, wherein, upon compression of the tension spring to a compressed orientation, movement of the stop cap for compressing the tension spring results in a corresponding retraction of the locking wedge into the grip portion and away from the base portion to provide means for arranging the base portion and the grip portion in an unlocked orientation.

8. The grip according to claim 7, wherein, upon expanding the spring from the compressed orientation toward an unbiased, expanded orientation, the tension spring provides:

means for biasing the stop cap away from the stop ring such that the locking wedge that is connected to the stop cap by way of the locking wedge fastener is moved out of the grip portion and into the base portion for arranging the base portion and the grip portion in a locked orientation.

9. The grip according to claim 4, wherein the second, outer body includes:

a radially-inwardly projecting annular ledge including an inwardly-facing threaded surface, and an upper surface, wherein the carrier body includes a first, outer threaded surface portion located proximate a first, upper end of the carrier body, and a second, outer threaded surface portion located proximate a second, lower end of the carrier body, wherein the inwardly-facing threaded surface of the annular ledge is threadingly-coupled to the second, outer threaded surface portion of the carrier body.

10. The grip according to claim 9, wherein the stop ring includes:

an upper surface, a lower surface, and an outer threaded surface portion, wherein the lower surface of the stop ring is disposed adjacent the upper surface of the radially-inwardly projecting annular ledge, wherein the first, inner body of the grip portion includes an outer surface portion, and an inner threaded surface, wherein the outer threaded surface portion of the stop ring is threadingly-coupled to the inner threaded surface of the first, inner body.

11. The grip according to claim 10, wherein the stop cap includes:

an outwardly-facing surface portion, and a plurality of inwardly-facing, stepped surface portions formed by stepped surfaces, wherein the stepped surfaces include:

a first threaded surface portion, a first ledge surface portion, a first non-threaded surface portion, a second ledge surface portion, and a second non-threaded surface portion, wherein the first threaded surface portion is substantially perpendicularly connected to the first ledge surface, wherein the first ledge surface portion is substantially perpendicularly connected to the first non-threaded surface portion, wherein the first non-threaded surface portion is substantially perpendicularly connected to the second ledge surface portion, wherein the second ledge surface portion is substantially perpendicularly connected to the second non-threaded surface portion.

12. The grip according to claim 11, wherein the first threaded surface portion of the stop cap is threadingly-coupled to the first, outer threaded surface portion of the carrier body, wherein the first ledge surface of the stop cap is disposed adjacent the first, upper end of the carrier body.

13. The grip according to claim 12, wherein the locking wedge fastener includes:

a head portion, and a stem portion connected to the head portion, wherein the first non-threaded surface portion of the stop cap forms an annular cavity that receives the a head portion of the locking wedge fastener, wherein the second ledge surface portion of the stop cap is disposed adjacent a surface portion of the head portion of the locking wedge fastener, wherein the second non-threaded surface portion of the stop cap forms a passage extending through the stop cap, wherein the passage extending through the stop cap permits the stem portion of the locking wedge fastener to extend therethrough and beyond an upper surface portion of the stop cap.

14. The grip according to claim 13, wherein the locking wedge includes:

a lower surface, an upper surface, and an outer surface connecting the lower surface to the upper surface, wherein the lower surface of the locking wedge is disposed substantially adjacent the upper surface portion of the stop cap, wherein the lower surface of the locking wedge forms a threaded bore extending into the locking wedge, wherein the threaded bore is coupled to a threaded outer surface of the stem portion of the locking wedge fastener.

15. The grip according to claim 13, wherein the tension spring includes:

a first end disposed adjacent a lower surface portion of the stop cap, and a second end disposed adjacent the upper surface of the stop ring, and wherein the tension spring circumscribes the outer surface portion of the carrier body.

16. A grip that is attachable to a device, comprising:

a base portion;

a grip portion pivotably connected to the base portion for arrangement in one of: a deployed orientation, a stowed orientation and an intermediate orientation, wherein the grip portion includes a first, inner body, and a second, outer body, wherein the second, outer body is movably- and telescopingly-connected to the first, inner body; and a locking assembly arranged within and at least partially contained by the grip portion, wherein a portion of the locking assembly is selectively-extendable in one of an orientation within the grip portion and beyond an outer surface of the grip portion for selective coupling of the portion of the locking assembly with the base portion, wherein the deployed orientation includes: a grip portion axis that is axially aligned with the grip portion while also substantially perpendicularly traversing a device axis of the device, wherein the stowed orientation includes the grip portion axis being arranged substantially in parallel with the device axis, wherein the base portion includes a head portion and a neck portion, wherein the neck portion includes a passage, wherein a pivot pin extends through the passage and is connected to the grip portion for pivotably-connecting the base portion to the grip portion.

17. The grip according to claim 16, wherein the head portion includes:

a quick-disconnect device, wherein the quick-disconnect device includes a first clamp portion, and a second clamp portion, wherein the first clamp portion and the second clamp portion collectively form a channel.

18. The grip according to claim 17, wherein the second clamp portion is movably-arranged with respect to a fixed orientation of the first clamp portion to provide:

means for enlarging/reducing a geometry of the channel for permitting detachment/attachment of the head portion to the device, wherein the device is a firearm, wherein, upon attachment of the head portion to the firearm, the channel includes a geometry that corresponds to a geometry of a Picatinny rail of the firearm.

19. A method for operating a grip including a locking assembly, wherein the grip includes a base portion and a grip portion, wherein the grip portion includes a first, inner body and a second, outer body, wherein the second, outer body is movably- and telescopingly-connected to the first, inner body, wherein the locking assembly is arranged within and at least partially contained by the grip portion, comprising the steps of:

arranging the grip portion in a deployed, first locked orientation relative to the base portion such that the grip portion is not collapsed substantially adjacent the base portion;

applying a pulling force to the grip portion for arranging the grip portion in an unlocked orientation relative to the base portion;

while the grip portion is arranged in the unlocked orientation relative to the base portion, pivoting the grip portion relative to the base portion; and responsive to the pivoting of the grip portion relative to the base portion, arranging the grip portion in a substantially collapsed orientation adjacent the base portion responsive to the arranging step, locking the grip portion in a stowed, second locked orientation relative to the base portion.

20. The method according to claim 19, wherein the pivoting step includes:

pivoting the grip portion relative to the base portion approximately about 90° such that in the deployed orientation, a body of the grip portion is substantially perpendicularly arranged relative to the base portion, and in the stowed orientation, the body of the grip portion is substantially arranged in parallel with the base portion.

21. The method according to claim 19, wherein responsive to the applying the pulling force step, further comprising the step of:

retracting a male portion of the grip portion out of a first recess formed in the base portion.

22. The method according to claim 21, wherein the locking step includes the step of:

biasing the male portion into a second recess formed in the base portion.

23. An assembly, comprising:

a device including a body, wherein a body axis extends along the body of the device;

a foregrip including:

a base portion, and a grip portion, wherein a grip axis extends along the grip portion, wherein the grip portion is pivotably connected to the base portion for arrangement in one of: a deployed orientation relative to the device, a stowed orientation relative to the device and an intermediate orientation relative to the device, wherein the grip axis is substantially perpendicular to the body axis when the grip portion is arranged in the deployed orientation, wherein the grip axis is substantially in parallel with the body axis when the grip portion is arranged in the stowed orientation, wherein the grip portion includes a first, inner body, and a second, outer body, wherein the second, outer body is movably- and telescopingly-connected to the first, inner body; and a locking assembly arranged within and at least partially contained by the grip portion, wherein a portion of the locking assembly is selectively-extendable in one of an orientation within the grip portion and beyond an outer surface of the grip portion for selective coupling of the portion of the locking assembly with the base portion.

24. The assembly according to claim 23, wherein the device is a firearm, wherein the body of the firearm is a barrel portion of the firearm.

25. The assembly according to claim 24, wherein barrel portion of the firearm includes:

an attachment rail, wherein the base portion includes a quick-disconnect device, wherein the quick-disconnect device includes a first clamp portion and a second clamp portion, wherein the first clamp portion and the second clamp portion collectively form a channel including a geometry that corresponds to the attachment rail of the firearm.

26. The assembly according to claim 25, wherein the attachment rail includes a Picatinny rail.

27. The assembly according to claim 24, wherein the firearm includes a handle-grip and trigger, wherein the foregrip is located in a forward orientation with respect to the handle-grip and trigger.

* * * * *